United States Patent [19]

Haselkorn

[11] Patent Number: 4,498,936

[45] Date of Patent: Feb. 12, 1985

[54] INSULATIVE COATING COMPOSITION FOR ELECTRICAL STEELS

[75] Inventor: Michael H. Haselkorn, Franklin, Ohio

[73] Assignee: Armco Inc., Middletown, Ohio

[21] Appl. No.: 612,450

[22] Filed: May 21, 1984

[51] Int. Cl.[3] ..... C23F 7/10

[52] U.S. Cl. ..... 148/6.15 R; 148/113; 106/286.5; 106/286.2

[58] Field of Search ..... 148/6.15 R, 113; 106/286.5, 286.2

[56] References Cited

U.S. PATENT DOCUMENTS 3,948,786 4/1976 Evans ..... 255/63.5

3,996,073 12/1976 Evans ..... 148/6.15 R 4,190,468 2/1980 Kitayama et al. ..... 148/12 A

FOREIGN PATENT DOCUMENTS 2500335 8/1982 France ..... 148/6.15 R

*Primary Examiner*—Sam Silverberg

*Attorney, Agent, or Firm*—Frost & Jacobs

[57] ABSTRACT

An insulative coating composition for electrical steels containing $Al^{+++}$, $Mg^{++}$, $H_2PO_4^-$ and aluminum silicate in specified proportions, in the form of a stable aqueous suspension which provides a tension-imparting coating having good curing characteristics and which imparts improved magnetic properties to electrical steels.

14 Claims, No Drawings

INSULATIVE COATING COMPOSITION FOR ELECTRICAL STEELS

BACKGROUND OF THE INVENTION

This invention relates to improved insulative coatings for electrical steels, more particularly to an aqueous coating composition which does not contain colloidal silica or chromic acid for forming a tension producing insulative coating which provides improved core loss in the electrical steels.

As used herein the terms "electrical steel" and "silicon steel" relate to an alloy which may have a typical but non-limiting composition, in weight percent, of about 0.06% maximum carbon, about 4% maximum silicon, about 0.03% maximum sulfur or selenium, about 0.02% to 0.4% manganese, about 0.4% maximum aluminum, and balance essentially iron.

The insulative coatings of the present application can be applied to carbon steels for electrical uses, non-oriented silicon steels and silicon steels having various orientations. The coating solutions of the present invention may be applied to silicon steels with or without a mill glass base coating. The invention has particular utility for application to cube-on-edge oriented silicon steel of regular grade or high permeability grade, wherein the body-centered cubes making up the grains are oriented in a position designated at (110)[001] in accordance with Miller's indices. As is well known in the art cube-on-edge oriented silicon steel sheet has numerous uses, such as in laminated magnetic cores for power transformers and the like.

In the manufacture of cube-on-edge oriented silicon steel an annealing separator is used during the final anneal to which the silicon steel strip or sheet is subjected, and if a magnesia or magnesia-containing annealing separator is used, a glass film is formed upon the surfaces of the strip or sheet, which is generally known in the industry as "mill glass".

So-called secondary coatings are also well known in the art which are used in addition to or in place of a mill glass coating. Such secondary coatings generally impart tension because of thermal expansion differences. Such tension refines the domain wall spacing which in turn results in improved magnetic quality in the silicon steel strip and sheet.

U.S. Pat. Nos. 3,996,073 and 3,948,786 disclose insulative coatings which may be used in addition to or in place of a mill glass on silicon steel strip. A coating solution, in accordance with these patents, contains aluminum, magnesium and phosphate in the following relative relationship on a water-free basis:

From 3 to 11% by weight $Al^{+++}$ calculated as $Al_2O_3$, from 3 to 15% by weight $Mg^{++}$ calculated as MgO and from 78 to 87% by weight $H_2PO_4^-$ calculated as $H_3PO_4$, with the concentration of $Al^{+++}$, $Mg^{++}$ and $H_2PO_4^-$ *comprising* 100 parts by weight calculated as aluminum oxide, magnesium oxide and phosphoric acid respectively on a water-free basis.

The solution further contains from 0 to 150 parts by weight of colloidal silica on a water-free basis, at least 45% by weight of the coating solution being water. When colloidal silica is present, within the range of 33 to 150 parts by weight on a water-free basis, at least 60% by weight of the coating solution must be water, and from 10 to 25 parts by weight chromic anhydride for every 100 parts by weight $H_2PO_4^-$, calculated as $H_3PO_4$, are needed in order to stabilize the colloidal silica and to provide satisfactory adherence, lack of hygroscopicity and "tack" after curing. When applied as a secondary coating in addition to a mill glass base coating, the insulative coating of these patents imparts tension to electrical steel strip, thereby improving magnetic properties.

U.S. Pat. Nos. 3,501,846 and 2,492,095 disclose phosphate coatings for silicon steels.

Magnesium phosphate based and aluminum phosphate based secondary coatings are disclosed in U.S. Pat. Nos. 2,743,203; 3,151,000; 3,594,240, 3,687,742, and 3,856,568.

U.S. Pat. No. 3,649,372 discloses a composition for an applied insulative coating comprising mono-basic magnesium phosphate, aluminum nitrate and/or aluminum hydroxide, together with chromic anhydride.

Belgian Pat. No. 789,262 discloses an applied insulative coating obtained from a solution of mono-aluminum phosphate, colloidal silica and chromic acid or magnesium chromate. This is alleged to be a tension-imparting film.

U.S. Pat. No. 3,948,786 states that the presence of colloidal silica in the composition may be required in order to prevent adherence of the applied coatings to furnace rolls in a conventional roller hearth furnace used for thermal flattening. However, whenever colloidal silica is added without chromic anhydride the stability of the aqueous solution is adversely affected, i.e. the composition increases in viscosity with time and may form a gel. The addition of chromic anhydride was found to stabilize the solution, but chromic anhydride is very expensive and is toxic.

SUMMARY

It is an object of the present invention to provide a composition for forming an insulative coating on electrical steels which eliminates both colloidal silica and chromic anhydride but which exhibits satisfactory stability and provides a tension-imparting coating having good curing characteristics, good adherence and lack of hygroscopicity and tack.

It is a further object to provide an anti-stick coating composition having the same proportions of components on a water-free basis but in a more dilute suspension in order to form a thin coating with a weight less than 2 grams/$m^2$ on each side of the steel.

According to the invention there is provided an aqueous coating composition for forming an insulative coating directly on electrical steels and on electrical steels having a mill glass thereon, the composition consisting essentially of, on a water-free basis, from 3 parts to 11 parts by weight $Al^{+++}$ calculated as $Al_2O_3$, from 3 parts to 15 parts by weight $Mg^{++}$ calculated as MgO, from 78 parts to 87 parts by weight $H_2PO_4^-$ calculated as $H_3PO_4$, the sum of the $Al^{+++}$, $Mg^{++}$ and $H_2PO_4^-$ totaling 100 parts by weight on a water-free basis calculated as $Al_2O_3$, MgO and $H_3PO_4$, respectively, and from about 30 parts to about 250 parts by weight aluminum silicate calculated as $Al_2O_3.SiO_2$ per 100 parts $Al_2O_3$, MgO and $H_3PO_4$, on a water-free basis, at least 50% by weight of the composition being water.

Aluminum silicate as used herein is intended to designate a water-washed or calcined kaolin substantially free from moisture, sand, mica and water soluble salts, which is capable of reacting with the phosphoric acid in the coating during curing.

Kaolinite in the natural state is conventionally designated as having a chemical formula of $Al_2(Si_2O_5)(OH)_4$. When processed, kaolin is conventionally represented as $Al_2O_3.SiO_2$ although the aluminum and silicon are combined as a complex and do not exist as free oxides.

The aqueous coating composition of the present invention forms a suspension which is stable against settling for substantial periods of time. Even if settling does occur, agitation will readily bring the aluminum silicate back into suspension.

The insulative coatings formed from the aqueous coating composition of the invention have been found to improve the core loss of electrical steels to which the coatings are applied. Accordingly, the invention provides a method of improving the core loss of electrical steels which comprises applying the aqueous composition defined above to an uncoated electrical steel strip or to an electrical steel strip having a mill glass thereon, drying the composition, and curing the coating at a temperature of 370°-870° C. (700°-1600° F.) for 0.5 to 3 min. in air, $N_2$ or $N_2$-$H_2$ mixtures containing a small amount of $H_2$, whereby to form a tension-imparting insulative film on the strip.

DETAILED DESCRIPTION

As indicated above, the aqueous coating composition of the present invention has particular utility for use with cube-on-edge oriented silicon steels having a mill glass thereon, and exemplary embodiments will be described in their application to such steels.

As is well known in the art, the manufacture of cube-on-edge oriented silicon steel includes the steps of providing ingots or cast slabs of an alloy having the composition hereinabove described, hot rolling to hot band thickness, removing hot mill scale, optionally annealing prior to cold reduction, cold rolling to final thickness in one or more stages, optionally with an intermediate anneal between stages, decarburizing, applying an annealing separator coating, and subjecting the coated steel strip to a final high temperature anneal in which secondary grain growth occurs, thereby producing the desired cube-on-edge orientation.

When applying the coating of the present invention over a mill glass formed during the final high temperature anneal, any excess annealing separator is removed by scrubbing or light pickling, and the aqueous composition of the invention is applied in conventional manner, e.g. by means of grooved applicator rolls, followed by drying and curing at a temperature of about 370°-870° C. (700°-1600° F.) in a non-oxidizing atmosphere, e.g. a dry 95% nitrogen, 5% hydrogen atmosphere, in a neutral atmosphere, or in an oxidizing atmosphere such as air for ½ to 3 minutes.

If a stress relief anneal is conducted, which is ordinarily within the range of about 760° to about 870° C. (1400° to about 1600° F.), a minimum of about 80 parts by weight aluminum silicate should be present in the composition, calculated as $Al_2O_3.SiO_2$ per 100 parts $Al_2O_3$, MgO and $H_3PO_4$, on a water-free basis, in order to prevent sticking of the coating. It is within the scope of the invention to perform the curing, or drying and curing, as part of another heat treatment, such as a stress relief anneal or a conventional flattening heat treatment.

The manner of application, roll grooving and coating weight may be identical to the conditions disclosed in the above-mentioned U.S. Pat. Nos. 3,948,786 and 3,996,073. Moreover, the $Al^{+++}$, $Mg^{++}$ and $H_2PO_4^-$ concentrations are identical to those disclosed in these United States patents, and the disclosures thereof are to be considered as incorporated herein by reference.

The aluminum silicate used in the aqueous coating composition of the present invention may have an average particle size up to about 0.3 microns. Good results have been obtained with a type sold by Engelhard Mineral and Chemical Company under the registered trademark ASP, grade 072. It is described by the manufacturer as being a water-washed kaolin processed to remove moisture, sand, mica and water soluble salts. The product is non-hygroscopic, substantially inert and insoluble under normal conditions. Typical chemical composition is stated by the manufacturer to be as follows:

| | |
|---|---|
| Silicon (as $SiO_2$) | 45-46% |
| Aluminum (as $Al_2O_3$) | 38-39% |
| Iron (as $Fe_2O_3$) | up to 0.3% |
| Titanium (as $TiO_2$) | up to 1.5% |
| Calcium (as CaO) | up to 0.1% |
| Sodium (as $Na_2O$) | up to 0.1% |
| Potassium (as $K_2O$) | trace |
| Loss on Ignition | 13-14% |

Typical physical properties are as follows:

| | |
|---|---|
| Average particle size (microns) | 0.3 |
| Retained on 325 mesh (44 microns) | 0.01% max. |
| Oil absorption (ASTM DZ81-31) | 37-41 |
| pH | 6.3-7.0 |
| Bulk density (lb/ft$^3$) Loose | 42-46 |
| Firm | 52-56 |
| Free moisture | 1.0% max. |

Aluminum silicate suitable for the practice of the invention may be broadly defined as containing, in weight percent, about 44% to 54% silicon calculated as silicon dioxide, about 37% to about 45% aluminum calculated as aluminum oxide, about 0.5% to about 14% water loss on ignition, and trace elements.

Initial laboratory tests demonstrated that an aqueous coating composition within the ranges defined hereinabove and containing about 83 parts by weight aluminum silicate (Engelhard ASP-072) per 100 parts $Al_2O_3$, MgO and $H_3PO_4$ on a water free basis could be applied as a secondary coating and cured without encountering problems. A coating thickness of about 0.025 mm thickness provided 0.00 amp Franklin Resistivity and exhibited good adherence on glass film blanks of both good and poor quality glass. The coating had a milky, white matte appearance.

The effect of the coating composition of the invention on the magnetic quality of cube-on-edge oriented silicon steel strip was determined in the following tests:

EXAMPLE 1

The starting material consisted of glass film blanks from 0.279 mm regular grade oriented and 0.229 mm regular grade oriented coils. From each coil, four sets of five 11.4 cm×30.5 cm blanks, sheared across the width of the strip, were prepared. Two sets were then combined (1 and 3 and 2 and 4) to make two 10 blank sets. After shearing the glass film blanks were stress-relief annealed for 2 hours at 815° C. (1500° F.) in a dry 95% nitrogen, 5% hydrogen atmosphere. The glass film blanks were next tested for core loss at 1.0, 1.5 and 1.7 Tesla and H=796 permeability. After testing the first set was coated with the coating composition disclosed in U.S. Pat. No. 3,948,786 (containing colloidal silica and chromic anhydride) while the second set was coated with the coating composition of the present invention (containing 7.47 parts by weight $Mg^{++}$ as MgO, 8.78 parts by weight $Al^{+++}$ as $Al_2O_3$, 83.75 parts by weight $H_2PO_4^-$ as $H_3PO_4$ and 104 parts by weight of Engelhard ASP-072 aluminum silicate per 100 parts $Al_2O_3$, MgO and $H_3PO_4$, on a water-free basis). The coatings were dried at 370° C. and cured at 815° C. After curing, the blanks were stress-relief-annealed for 2 hours at 815° C. (1500° F.) in a dry 95% nitrogen, 5% hydrogen atmosphere. The blanks were then again subjected to the same magnetic testing as set forth above using the glass film weights in order to offset the effect of different secondary coating thicknesses. The results are summarized in Table I. The magnetic test data are given as the difference between the glass film, stress-relief-annealed (SRA) average and secondary coated, SRA average for each of the two sets of samples. A negative value indicates that the secondary coated value was lower.

It will be evident that for both the 0.229 mm and 0.279 mm samples the difference between the glass film core loss values and the core loss values with the secondary coating of the present invention at all three inductions was more negative than the corresponding values for the samples coated in accordance with the coating solution for U.S. Pat. No. 3,948,786. It will of course be understood that a decrease in core loss is desirable.

Referring to Table II, the data therein show that the coating of the present invention provides adequate surface insulation (Franklin Resistivity) after the SRA at 815° C. (1500° F.) for 2 hours in a dry 95% nitrogen, 5% hydrogen atmosphere. No sticking of the coating was noticed, and it bonded well to the mill glass film both before and after the SRA.

EXAMPLE 2

This trial was undertaken in order to confirm the magnetic property results of Example 1 and to determine the parameters of the aluminum silicate content of the coating composition from the standpoint of curing characteristics, Franklin Resistivity after an SRA and magnetic quality after secondary coating.

For these tests 0.229 mm regular grain oriented glass film blanks and 0.279 mm regular grain oriented glass film blanks from two different coils of commercially produced material were used. The compositions which were evaluated contained aluminum, magnesium and phosphate ions within the ranges of the invention as set forth above and aluminum silicate additions (Engelhard ASP-072) in the following amounts (per 100 parts by weight $Al_2O_3$, MgO and $H_3PO_4$ on a water-free basis):

33.2 parts by weight on a water-free basis
83.0 parts by weight on a water-free basis
166 parts by weight on a water-free basis
249 parts by weight on a water-free basis After mixing all coating compositions were diluted to 1.30 specific gravity. For purposes of comparison control compositions in accordance with U.S. Pat. No. 3,948,786 were used, containing colloidal silica in an amount equal to 88 parts by weight on a water-free basis and 25 parts by weight chromic anhydride for every 100 parts by weight $H_2PO_4^-$ calculated as $H_3PO_4$.

The procedure for evaluating the effect of the four different concentrations of aluminum silicate on both thicknesses of silicon steel with respect to magnetic quality was similar to that outlined above. Table III contains the data from these tests, and the results are given as the difference between glass film SRA and secondary coated SRA magnetic quality. Each sample consisted of two sets of five 11.4 cm×30.5 cm blanks sheared across the width of the strip. Each data point was the average of 10 individual tests.

Table III indicates that in both the 0.229 mm and 0.279 mm samples the optimum secondary coated magnetic quality after SRA was achieved with the composition containing 166 parts by weight aluminum silicate. The data also indicate that increasing the aluminum silicate content from 33.2 to 166 parts by weight per 100 parts $Al_2O_3$, MgO and $H_3PO_4$ had little effect in changing the core loss at B=1.0 or B=1.5 T. However, the B=1.7 T core loss value improved approximately 0.0198 to 0.0242 Watt/kg with increasing aluminum silicate content. In Table III, as in Table I, testing was based on the glass film weights in order to offset the effect of different secondary coating thicknesses.

Table IV contains Franklin Resistivity values of the samples of Table III. Table IV indicates that an aluminum silicate content of at least 83 parts by weight, on a water-free basis, is required to provide Franklin values after a SRA similar to the coating composition of U.S. Pat. No. 3,948,786. It was also found that an aluminum silicate content of about 80 parts by weight per 100 parts $Al_2O_3$, MgO and $H_3PO_4$ on a water-free basis was required in order to prevent sticking between blanks during an SRA conducted in the laboratory.

A comparison of core loss values of the coating composition of the present invention containing 166 parts by weight aluminum silicate per 100 parts $Al_2O_3$, MgO and $H_3PO_4$ on a water-free basis with the coating of U.S. Pat. No. 3,948,786 after an SRA indicates the following:

On the 0.229 mm material the core loss values were 0.0022 W/kg at B=1.0 T, 0.0066 W/kg at B=1.5 T, and 0.0198 W/kg at B=1.7 T more negative for the coating of the present invention. For the 0.279 mm material the differences were 0.0011 W/kg at B=1.0 T, 0.0044 W/kg at B=1.5 T, and 0.0154 W/kg at B=1.7 T more negative for the coating of the present invention.

These data thus indicate an improvement in secondary coated magnetic quality when using the composition of the present invention with about 165 parts by weight aluminum silicate per 100 parts $Al_2O_3$, MgO and $H_3PO_4$ on a water-free basis.

The adherence of the secondary coating produced with the composition of the present invention was very similar to that of the coatings produced by the composition of U.S. Pat. No. 3,948,786. It was further noted that less glass film oxidation occurred with the coatings produced by the present composition either after drying and firing, or after a laboratory SRA, compared to the coated samples of U.S. Pat. No. 3,948,786.

A preferred mixing procedure for preparation of the coating composition of this invention is to suspend the aluminum silicate in demineralized or distilled water, with from about 15 to about 120 parts by weight of aluminum silicate to 100 parts by volume of water. The suspension may then be added to an aqueous aluminum-magnesium-phosphate solution prepared in accordance with the teachings of U.S. Pat. No. 3,948,786. For example, mono-aluminum phosphate solution, magnesium phosphate and water may be mixed in proportions suitable to obtain the aluminum, magnesium and phosphate ion ranges set forth above. The mixture is then agitated and may be diluted to a specific gravity suitable to the method of application, e.g. about 1.25 to about 1.35.

If used as an anti-stick coating, dilution to a greater extent is practiced in order to produce a low coating weight.

Drying furnace temperatures, coating roll practice and the like may be the same as those disclosed in U.S. Pat. No. 3,948,786.

TABLE I

CHANGE IN MAGNETIC QUALITY AFTER SECONDARY COATING

| | Using Glass Film Weights | | | |
|---|---|---|---|---|
| | Change in Core Loss at | | | H = 10 |
| | B = 1.0T | B = 1.5T | B = 1.7T | Perm |
| 0.279 mm RGO - Avg. of 2 Coils | | | | |
| U.S. Pat. No. 3,948,785 | −.0066 | — | −.0308 | +5 |
| Example 1 | −.0084 | −.0088 | −.0418 | +4 |
| 0.229 mm RGO - Avg. of 1 Coil | | | | |
| U.S. Pat. No. 3,948,786 | −.0033 | −.0088 | −.0594 | +5 |
| Example 1 | 0.0040 | −.0088 | −.0704 | +5 |

All core loss values are in watts/kg.

TABLE II

FRANKLIN RESISTIVITY AFTER SECONDARY COATING AND STRESS-RELIEF-ANNEAL

| | |
|---|---|
| 0.279 mm RGO Coil | |
| U.S. Pat. No. 3,948,786 | .16 amps |
| Example 1 | .01 amps |
| 0.279 mm RGO Coil | |
| U.S. Pat. No. 3,948,786 | .02 amps |
| Example 1 | .01 amps |
| 0.229 mm RGO Coil | |
| U.S. Pat. No. 3,948,786 | .24 amps |
| Example 1 | .01 amps |

All values average of 20 tests - taken on top and bottom of 10, 12.7 cm wide strips

TABLE III

CHANGE IN MAGNETIC QUALITY AFTER SECONDARY COATING

| | 0.229 mm RGO Glass Film Weight | | | | 0.279 mm RGO Glass Film Weight | | | |
|---|---|---|---|---|---|---|---|---|
| | Change in Core Loss at | | | Change in H = 10 | Change in Core Loss at | | | Change in H = 10 |
| | B = 1.0T | B = 1.5T | B = 1.7T | Perm | B = 1.0T | B = 1.5T | B = 1.7T | Perm |
| U.S. Pat. No. 3,948,786 | −.0059 | −.0066 | −.0418 | +3 | −.0086 | −.0066 | −.0330 | −8 |
| Example 2 with: | | | | | | | | |
| 33.2 parts ASP-072 | −.0077 | −.0154 | −.0374 | +1 | −.0088 | −.011 | −.0286 | +2 |
| 83.0 parts ASP-072 | −.0086 | −.0132 | −.0484 | +4 | −.0106 | −.011 | −.0374 | +2 |
| 166 parts ASP-072 | −.0081 | −.0132 | −.0616 | +4 | −.0097 | −.011 | −.0484 | −7 |
| 249 parts ASP-072 | −.0081 | −.0132 | −.0594 | +3 | −.0112 | −.0176 | −.0418 | −7 |

(Parts per 100 parts by weight MgO, $Al_2O_3$, $H_3PO_4$ on a water-free basis)
All core loss values are in watts/kg

TABLE IV

FRANKLIN RESISTIVITY AFTER SECONDARY COATING AND STRESS-RELIEF-ANNEAL (Average of 16 tests on both 0.279 and 0.229 RGO samples.)

| | |
|---|---|
| U.S. Pat. No. 3,948,786 | .08 amps |
| Example 2 | |
| 33.2 parts ASP-072 | .31 amps |
| 83.0 parts ASP-072 | .02 amps |
| 166 parts ASP-072 | .01 amps |
| 249 parts ASP-072 | .00 amps |

(Parts by weight, water-free basis)

I claim:

1. An aqueous coating composition for forming an insulative coating directly on electrical steels and on electrical steels having a mill glass thereon, said composition consisting essentially of, on a water-free basis, from 3 parts to 11 parts by weight $Al^{+++}$ calculated as $Al_2O_3$, from 3 parts to 15 parts by weight $Mg^{++}$ calculated as MgO, from 78 parts to 87 parts by weight $H_2PO_4^-$ calculated as $H_3PO_4$, the sum of said $Al^{+++}$, $Mg^{++}$ and $H_2PO_4^-$ totaling 100 parts by weight on a water-free basis calculated as $Al_2O_3$, MgO and $H_3PO_4$, respectively, and from about 30 parts to about 250 parts by weight aluminum silicate calculated as $Al_2O_3.SiO_2$ per 100 parts $Al_2O_3$, MgO, and $H_3PO_4$, on a water-free basis, at least 50% by weight of said composition being water.

2. The composition of claim 1, wherein said aluminum silicate is from about 80 to about 250 parts by weight calculated as $Al_2O_3.SiO_2$, on a water-free basis.

3. The composition of claim 1, wherein said aluminum silicate comprises a water-washed kaolin substantially free from moisture, sand, mica and water soluble salts, having an average particle size up to about 0.3 micron.

4. The composition of claim 3, wherein said aluminum silicate is present in an amount of about 80 to 250 parts by weight, on a water-free basis, calculated as $Al_2O_3.SiO_2$, and wherein said aqueous composition is a suspension stable against settling.

5. The composition of claim 1, containing water in an amount sufficient to result in a specific gravity of about 1.25 to 1.35.

6. The composition of claim 5, wherein said aluminum silicate is present in an amount of about 80 to 250 parts by weight, on a water-free basis, calculated as $Al_2O_3.SiO_2$, and wherein said aqueous composition is a suspension stable against settling.

7. The composition of claim 3, wherein said aluminum silicate contains, in weight percent, about 44% to about 54% silicon calculated as silicon dioxide, about 37% to about 45% aluminum calculated as aluminum oxide, about 0.5% to about 14% water loss on ignition, and trace elements.

8. A method of improving the core loss of electrical steels which comprises applying an aqueous composition to an uncoated electrical steel strip or to an electrical steel strip having a mill glass thereon, said aqueous composition consisting essentially of, on a water-free basis, from 3 parts to 11 parts by weight $Al^{+++}$ calculated as $Al_2O_3$, from 3 parts to 15 parts by weight $Mg^{++}$ calculated as MgO, from 78 parts to 87 parts by weight $H_2PO_4^-$ calculated as $H_3PO_4$, the sum of said $Al^{+++}$, $Mg^{++}$ and $H_2PO_4^-$ totaling 100 parts by weight on a water-free basis calculated as $Al_2O_3$, MgO and $H_3PO_4$, respectively, and from about 30 parts to about 250 parts by weight aluminum silicate calculated as $Al_2O_3.SiO_2$ per 100 parts $Al_2O_3$, MgO and $H_3PO_4$ on a water-free basis, at least 50% by weight of said composition being water, drying said composition, and curing the coating at a temperature of about 370° to 870° C. for 0.5 to 3 minutes, whereby to form a tension-imparting insulative film on said strip.

9. The method of claim 8, wherein said aluminum silicate comprises a water-washed kaolin substantially free from moisture, sand, mica and water soluble salts, having an average particle size up to about 0.3 micron.

10. The method of claim 9, wherein said aluminum silicate is present in an amount of about 80 to 250 parts by weight, on a water-free basis, calculated as $Al_2O_3.SiO_2$.

11. The method of claim 9, wherein said aluminum silicate contains, in weight percent, about 44% to about 54% silicon calculated as silicon dioxide, about 37% to about 49% aluminum calculated as aluminum oxide, about 0.5% to about 14% water loss on ignition, and trace elements.

12. The method of claim 8, wherein said composition contains from about 80 parts to about 250 parts by weight of said aluminum silicate calculated as $Al_2O_3.SiO_2$, on a water-free basis, and including the step of annealing the coated strip at about 760° to about 870° C.

13. The method of claim 12, wherein said curing step is a part of said annealing step.

14. The method of claim 12, wherein said curing and said annealing steps are conducted in a non-oxidizing, neutral or oxidizing atmosphere.

* * * * *